United States Patent [19]

Shiao et al.

[11] 4,207,392

[45] Jun. 10, 1980

[54] HEAT DEVELOPABLE AND STABILIZABLE PHOTOGRAPHIC MATERIALS AND PROCESS

[75] Inventors: Daniel D. Shiao, Victor; Lawrence R. Morrow, Churchville, both of N.Y.

[73] Assignee: Eastman Kodak Company, Rochester, N.Y.

[21] Appl. No.: 955,678

[22] Filed: Oct. 30, 1978

[51] Int. Cl.[2] ..... G03C 5/38; G03C 1/02

[52] U.S. Cl. ..... 430/352; 430/353; 430/448; 430/607; 430/617; 430/955; 430/964

[58] Field of Search ..... 96/114.1, 66.3, 66.4, 96/48 HD, 109, 50, 61; 427/56

[56] References Cited

U.S. PATENT DOCUMENTS

| | | | |
|---|---|---|---|
| 3,152,904 | 10/1964 | Sorensen et al. | 96/114.1 |
| 3,442,682 | 5/1969 | Fukawa | 427/56 |
| 3,457,075 | 7/1969 | Morgan et al. | 96/114.1 |
| 3,468,664 | 9/1969 | Stewart | 96/63 |
| 3,547,634 | 12/1970 | Hori et al. | 96/48 HD |
| 3,667,958 | 6/1972 | Evans | 96/114.1 |
| 3,730,727 | 5/1973 | Olivares et al. | 96/66.3 |
| 3,782,949 | 1/1974 | Olivares et al. | 96/76 R |
| 4,030,925 | 6/1977 | Leone et al. | 96/95 |
| 4,060,420 | 11/1977 | Merkel et al. | 96/114.1 |
| 4,088,496 | 5/1978 | Merkel | 96/114.1 |

OTHER PUBLICATIONS

Product Licensing Index, vol. 92, Dec. 1971, Publication 9232.

Research Disclosure, vol. 170, Jun. 1978, item 17029.

*Primary Examiner*—J. Travis Brown

*Attorney, Agent, or Firm*—Richard E. Knapp

[57] ABSTRACT

An activator-stabilizer precursor which comprises a certain acylhydrazine which releases a base moiety upon being heated to a temperature above about 130° C. provides improved heat developable and heat stabilizable photographic materials comprising, in binder, and in reactive association, (a) a photosensitive silver salt, (b) a photosensitive silver salt developing agent, and (c) a stabilizing concentration of the described activator-stabilizer precursor having an acid portion and a base portion. The heat developable and heat stabilizable photographic element provides essential freedom from visual crystal formation in the processed photographic element. After imagewise exposure, a developed and stabilized image can be produced in the photographic element by heating the element to processing temperature.

23 Claims, No Drawings

HEAT DEVELOPABLE AND STABILIZABLE PHOTOGRAPHIC MATERIALS AND PROCESS

BACKGROUND OF THE INVENTION

1. Field of the Invention

This invention relates to certain activator-stabilizer precursors for use in photographic materials for processing with heat. More specifically, this invention relates to such compounds having an acid portion and a base portion which comprise certain acylhydrazines which release a base moiety upon being heated to a temperature above about 130° C. One aspect of the invention relates to a heat developable and heat stabilizable photographic element comprising the described activator-stabilizer precursor. Another aspect relates to certain photographic compositions for processing with heat containing these compounds. A further aspect relates to a thermosensitive photographic processing composition containing the described activator-stabilizer precursors.

2. Description of the State of the Art

Photographic elements that are heat processable are well known. That is, a photographic element is known wherein a latent image can be developed after imagewise exposure by merely heating the element. Typically, such elements can contain photosensitive silver halide, a silver halide developing agent, and an activator precursor with, typically, a stabilizer precursor to provide a developed and stabilized image. Development of the latent image and stabilization occur substantially simultaneously as the result of two competing reactions. It is necessary that the activator precursors and stabilizer precursors or activator-stabilizer precursors in such heat processable photographic elements be such as to permit the respective reactions to take place without adversely affecting the desired sensitometric properties of the photographic element.

It is known to incorporate activator-stabilizer precursors into heat processable photographic materials. Typical activator-stabilizer precursors are described in, for instance, U.S. Pat. No. 4,012,260 of Dickerson and Merkel. An example of such an activator-stabilizer precursor is a 2-amino-2-thiazolium carboxylate. Upon heating the photographic material containing such an activator-stabilizer precursor and a developing agent, an agent is released that is capable of activating the developing agent to enable latent image development and substantially simultaneously permit stabilization of the resulting developed image in the photographic material. Another example of an activator-stabilizer precursor is described in U.S. Pat. No. 4,060,420 of Merkel and Ling. This activator-stabilizer precursor is one which contains a base moiety and an acid moiety in which the acid moiety is an α-sulfonylacetate. A further example of an activator-stabilizer precursor in a heat processable photographic element is described in U.S. Pat. No. 4,088,496 of Merkel. This relates to an activator-stabilizer precursor containing an acid moiety and a base moiety in which the acid moiety is a 2-carboxycarboxamide.

Certain problems have been encountered with the described activator-stabilizer precursors. The byproducts of the 2-amino-2-thiazolium carboxylates formed by decarboxylation are undesirably volatile at processing temperatures in the heat processable photographic element. The α-sulfonylacetate activator-stabilizer precursors provide activation and stabilization without significant volatile byproducts of decarboxylation; however, it has been noted that compounds containing the α-sulfonylacetate produce what is described in the photographic art as "pinholes" in the photographic element upon processing. "Pinholes" as described herein mean small areas of low density in the photographic material that can be readily observed visually through a 10X magnifier. The "pinholes" are most readily apparent in the maximum density areas of the developed photographic material. This property is particularly disadvantageous for microimaging purposes. The described 2-carboxycarboxamide activator-stabilizer precursors are useful to help avoid the described disadvantages. However, the photographic elements containing the 2-carboxycarboxamides produce an undesired degree of visible crystal formation in the processed photographic element. None of the described activator-stabilizer precursors have provided answers to other of the described problems as well as a suitable answer to this crystal formation problem. A continuing need has existed to find a suitable answer to the crystal formation problem, especially for photographic elements designed for microimaging.

Photographic materials containing a variety of hydrazine and hydrazide compounds are also known. Hydrazides have in certain instances been useful as activators in certain heat processable photographic materials. Such hydrazide activators are described in, for instance, U.S. Pat. No. 3,506,444 of Haist and Burness. In addition, hydrazine and hydrazides have been in some instances effective reducing agents in certain heat processable photographic materials. Such hydrazine and hydrazide reducing agents are described in, for example, U.S. Pat. No. 3,667,958 of Evans. The described hydrazine and hydrazide reducing agents do not contain heat releasable acid groups; this enables them to produce both activation and stabilization of an image in a photographic material that is designed to be heat processable. Also, hydrazide developing agents have been described in U.S. Pat. No. 3,782,949 of Olivares, Bean and Haist. The hydrazine developing agents, however, have no function as activator-stabilizer precursors in the photographic materials. In addition, the described hydrazinehydrazide reducing agents have provided no suitable answer to the problem of avoiding visible crystal formation in a heat processed photographic element as described.

There has been a continuing need for improved activator-stabilizer precursors that (a) do not produce undesirable volatile byproducts, (b) reduce the number of undesired "pinholes" and (c) help provide essential freedom from visible crystal formation in a heat developable and heat stabilizable photographic element as described herein.

SUMMARY OF THE INVENTION

According to this invention, the described properties are provided in a heat developable and heat stabilizable photographic material comprising, in binder, and in reactive association, (a) a photosensitive silver salt, such as photosensitive silver halide, (b) a photosensitive silver salt developing agent, and (c) a stabilizing concentration of an activator-stabilizer precursor having an acid portion and a base portion, wherein the activator-stabilizer precursor comprises an acylhydrazine which releases a base moiety upon being heated to a temperature above about 130° C. and provides essential freedom from visible crystal formation in the processed photographic material. Upon heating to the described temperature, it is believed that the described acylhydrazine releases a base which activates the developing agent and a stabilizing moiety which stabilizes the resulting developed image.

The described activator-stabilizer precursor is also useful in a thermosensitive photographic processing composition. The thermosensitive processing composition can comprise (a) a silver halide developing agent and (b) an activator-stabilizer precursor having an acid portion and a base portion wherein the described precursor comprises an acylhydrazine which releases a base moiety upon being heated to a temperature above about 130° C.

A process according to the invention of developing and stabilizing an image in an exposed photographic element as described comprises heating the element to processing temperature, such as to a temperature above about 130° C. and typically within the range of about 150° C. to about 190° C., until the image is developed and stabilized.

The term "activator-stabilizer precursor" as used herein is intended to mean a compound that, upon heating to processing temperature in a photographic material, as described, (1) produces at least one moiety that can activate the silver halide developing agent to develop latent image silver in the photographic material and (2) produces at least one moiety that can stabilize a developed silver image in the photographic material. The exact mechanism by which the described activator-stabilizer releases an activating moiety and a stabilizing moiety and the exact reaction rates that take place at processing temperatures are not fully understood.

DETAILED DESCRIPTION OF THE INVENTION

A variety of acylhydrazine activator-stabilizer precursors can be useful in the described photographic materials according to the invention. It is essential that the acylhydrazine release a base moiety upon being heated to a temperature above about 130° C. to produce the desired activation of the described silver halide developing agent. Selection of an optimum acylhydrazine activator-stabilizer precursor will depend upon such factors as the desired image, desired degree of stabilization, the particular photosensitive silver salt developing agent, processing conditions and the like. A typically useful acylhydrazine consists essentially of a compound represented by the structure:

$$R^3-\overset{\overset{\displaystyle O}{\|}}{C}-NH-NR^1R^2 \text{ or} \qquad \text{(I)}$$

$$[R^3-\overset{\overset{\displaystyle O}{\|}}{C}-NH-NH]_2-C{=}O \qquad \text{(II)}$$

wherein $R^1$ is hydrogen or alkyl containing 1 to 3 carbon atoms, such as methyl, ethyl and propyl;

$R^2$ is $-CO-R^4$ or $-SO_2-R^4$;

$R^3$ is 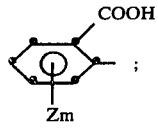

;

Z is hydrogen or an electron withdrawing group;

m is 1 to 4; when Z is hydrogen, m is 4;

$R^4$ is alkyl containing 1 to 3 carbon atoms, such as methyl, ethyl and propyl, or hydroxyalkyl containing 1 to 4 carbon atoms, such as hydroxymethyl and hydroxybutyl.

Preparation of the described acylhydrazine activator-stabilizer precursors can be carried out by procedures known in the chemical art. The synthesis of 1,5-(bis-o-carboxylbenzoyl)carbohydrazide, which may also be named as 1,5-(di-o-carboxylbenzoyl)carbazide, is typical of the preparation of acylhydrazine compounds useful according to the invention. In this preparation, phthalic anhydride (20 grams) can be dissolved in a minimum volume of acetonitrile. Carbohydrazide (6.3 grams) can be added and the mixture can be stirred vigorously for about 17 hours. The resulting solid can be filtered, slurried two times in hot acetonitrile, dried, slurried two times in room temperature water, then washed in acetonitrile and air dried. The desired resulting product melts at 288°-290° C. The desired compound can be represented by the structure:

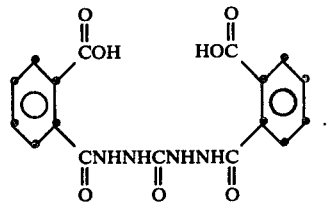

Another process for preparing an acylhydrazine as described is the process of preparing 1-(o-carboxybenzoyl)-2-(4-hydroxybutyryl)hydrazine. In this synthesis 4-butyrolactone (20 grams) can be added to 250 milliliters of ethanol. Then hydrazine (8.1 grams) can be added and the mixture refluxed for about one-half hour. The resulting solution can be allowed to cool with a white solid slowly precipitating in the reaction mixture. This precipitate can be filtered, recrystallized from ethanol and dried to provide a desired intermediate having a melting point of 90°-93° C. Then phthalic anhydride (18.9 grams) can be dissolved in a minimum volume of acetonitrile. The hydrazide intermediate (15.6 grams) can be added to the phthalic anhydride composition and the heterogenous mixture can be stirred vigorously for 10 hours. The resulting product can be filtered, slurried five times in boiling acetonitrile and washed several times with ether to produce the desired acylhydrazine activator-stabilizer precursor having a melting point of 136°-138° C. The desired acylhydrazine can be purified by means known in the chemical art.

One embodiment of the invention is an improved heat developable and heat stabilizable photographic element comprising a support having thereon, in binder, and in reactive association, (a) a photosensitive silver salt, such as photosensitive silver halide, (b) a photosensitive silver salt developing agent, and (c) a stabilizing concentration of an activator-stabilizer precursor having an acid portion and a base portion wherein the activator-stabilizer precursor comprises an acylhydrazine which releases a base moiety upon being heated to a temperature of about 130° C. and provides essential freedom from visible crystal formation in the processed photographic element.

Alkyl as used herein is intended to include alkyl that is unsubstituted or alkyl that is substituted with substituents which do not adversely affect the sensitometric or other desired properties of the heat developable and heat stabilizable photographic material as described. A suitable substituent group includes, for example, hydroxyl.

The term "photographic material" as used herein is intended to include photographic elements and photographic compositions. For example, a heat developable and heat stabilizable photographic material as used herein is intended to include heat developable and heat stabilizable photographic elements and heat developable and heat stabilizable photographic compositions.

A test can be useful for determining if the described photographic material according to the invention provides essential freedom from visible crystal formation in the processed photographic material. An example of such a test involves preparation, imagewise exposure and processing of a heat developable and heat stabilizable photographic element as described in Example 1 wherein the processed element is visually inspected without the aide of a magnifier and the crystal formation, if any, is observed visually with the unaided eye. Essential freedom from visual crystal formation as used herein means that the element has a degree of freedom from such crystals which cannot be detected visually with the unaided eye.

Examples of useful acylhydrazine activator-stabilizer precursors include the following compounds:

1,5-(bis-o-carboxybenzoyl)carbohydrazide, which can also be named as 1,5-(di-o-carboxybenzoyl)carbazide or 1,1'-carbonylbis[2-(o-carboxybenzoyl)-hydrazine]; 1-o-carboxybenzoyl-2-(4-hydroxybutyryl)hydrazine; and 1-(o-carboxybenzoyl)-2-acetyl-2-methylhydrazine. Other useful hydrazines are given in the following examples.

An especially useful embodiment of the invention is in a heat developable and heat stabilizable photographic element comprising a support having thereon, in a gelatino binder, and in reactive association, (a) photographic silver halide, (b) a 3-pyrazolidone silver halide developing agent, and a stabilizing concentration of (c) an activator-stabilizer precursor having an acid portion and a base portion, the improvement wherein the activator-stabilizer precursor consists essentially of 1,1'-carbonylbis[2-(o-carboxybenzoyl)hydrazine].

Another especially useful embodiment of the invention is a heat developable and heat stabilizable photographic element comprising a support having thereon, in a gelatino binder, and in reactive association, (a) photographic silver halide, (b) a silver halide developing agent consisting essentially of 4-hydroxymethyl-4-methyl-1-phenyl-3-pyrazolidone, and a stabilizing concentration of a combination of activator-stabilizer precursors consisting essentially of (c) 1,3-bis(2-amino-2-thiazolinyl)propane, (d) 1,3-bis-2S-(N,N'-ethyleneisothiourea)ethylurea, and (e) 1,1-carbonylbis[2-(o-carboxybenzoyl)hydrazine].

Combinations of activator-stabilizer precursors as described can be useful according to the invention if desired. An example of a combination of activator-stabilizer precursors is the combination of 1,1-carbonylbis[2-(o-carboxybenzoyl)hydrazine] with 1-o-carboxybenzoyl-2-(4-hydroxybutyryl)hydrazine.

Some of the activator-stabilizer precursors have limited solubility in aqueous formulations and may require some added solvents in preparing a composition for coating on a suitable support to produce a heat developable and heat stabilizable photographic element.

The photographic materials as described contain a photosensitive silver salt, preferably photosensitive silver halide due to its high degree of photosensitivity. Useful photosensitive silver halides include, for example, silver chloride, silver bromide, silver bromoiodide, silver chlorobromoiodide, silver iodide or mixtures thereof. The photosensitive silver halide can have a range of grain size from coarse grain to fine grain. The materials containing the photosensitive silver halide can be prepared by any of the well-known procedures in the photographic art. The activator-stabilizer precursors as described are especially useful with silver bromide and silver bromoiodide materials.

The photographic silver salt can be used in a range of concentrations in the photographic materials of the invention. Typically, a concentration of photosensitive silver salt, especially photosensitive silver halide, is used which produces, upon coating on a support, a photographic element containing a concentration within the range of about 1 to about 30 milligrams of silver per square decimeter.

A silver salt developing agent, typically a silver halide developing agent, is present in the photographic material as described to provide a developed image. Useful silver salt developing agents, typically silver halide developing agents, include for example, polyhydroxybenzenes such as hydroquinone developing agents, including, for example, hydroquinone, alkyl-substituted hydroquinones, such as tertiary-butylhydroquinone, methylhydroquinone, 2,5-dimethylhydroquinone and 2,6-dimethylhydroquinone; catechols and pyrogallol; chlorohydroquinone or dichlorohydroquinone; alkoxy substituted hydroquinone such as methoxyhydroquinone or ethoxyhydroquinone; methylhydroxynaphthalene; methylgallate; aminophenol developing agents such as 2,4-diaminophenols and methylaminophenols; ascorbic acid developing agents such as ascorbic acid, ascorbic acid ketals and ascorbic acid derivatives; hydroxylamine developing agents; pyrimidine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronimide developing agents; reductone developing agents, such as anhydrodihydropiperidino hexose reductone; furanone developing agents and the like. Combinations of developing agents can be useful if desired.

The term "silver salt developing agent" as used herein is intended to include developing agents and developing agent precursors. That is, the term includes compounds known as precursors which form a developing agent such as upon exposure to suitable energy, for example, light or heat.

The photosensitive silver salt developing agent can be used in a range of concentrations in the described heat developable and heat stabilizable photographic materials according to the invention. Typically, a concentration of photosensitive silver salt developing agent is used that is within the range of about 0.1 to about 2.0 moles of developing agent per mole of silver in the photographic material. Preferably, a concentration of developing agent is used that is within the range of about 0.5 to about 1.0 mole of developing agent per mole of silver in the photographic material. The optimum concentration of developing agent will depend upon such factors as the desired image, the particular photosensitive silver salt, the particular activator-stabilizer precursor, processing conditions and the like.

In a photographic material according to the invention, a useful concentration of activator-stabilizer precursor is typically within the range of about 0.2 to about 4.0 moles of activator-stabilizer precursor per mole of total silver in the photographic material. Preferably, the concentration of activator-stabilizer precursor is within the range of about 0.5 to about 2.0 moles of activator-stabilizer precursor per mole of total silver in the photographic material. The optimum concentration of the activator-stabilizer precursor will depend upon the described factors, such as the desired image, particular components of the photographic material, processing conditions and the like.

It is often useful to include an auxiliary stabilizer precursor in the described photographic material of the invention. Useful auxiliary stabilizer precursors include activator-stabilizer precursors such as those having an acid portion and a base portion. Especially useful auxiliary activator-stabilizer precursors are those having a base portion which is a protonated basic nitrogen-containing moiety and an acid portion that is an α-sulfonylacetate. Such α-sulfonylacetate compounds include those wherein the α-sulfonylacetate moiety is an ethylene bis(sulfonylacetate), methylene bis(sulfonylacetate) or phenylsulfonylacetate. An example of a useful auxiliary activator-stabilizer precursor is 1,3-bis(N,N'-ethyleneisothiourea)ethylurea.ethylenebis[N,N'-ethyleneisothiourea)ethyl]urea.ethylenebis(sulfonylacetate).

The auxiliary stabilizer precursor, such as activator-stabilizer precursor, can be used in a range of concentrations in the described photographic material according to the invention. A useful concentration of auxiliary stabilizer precursor, especially an activator-stabilizer precursor, is typically within the range of about 0.1 to about 1.0 mole of auxiliary stabilizer precursor per mole of silver in the described photographic material. The optimum concentration of auxiliary stabilizer precursor, especially auxiliary activator-stabilizer precursor, will depend upon such factors as the desired image, the particular components of the photographic material, the primary activator-stabilizer precursor, processing conditions and the like. Combinations of auxiliary stabilizer precursors, especially combinations of auxiliary activator-stabilizer precursors, can be useful if desired.

In some instances, a development restrainer is useful in the described photographic materials according to the invention in order to produce improved image discrimination. A development restrainer, as described herein, is intended to mean a compound which reduces development on fog centers producing lower minimum density values. An example of a useful development restrainer includes, for example, 1-methyl-3-[2-(methylcarbamoylthio)-ethyl]urea and bromide ion. A range of concentration of development restrainer can be useful in the described photographic material. Typically, a concentration of development restrainer is used that is within the range of about 0.01 to 0.2 mole of development restrainer per mole of silver in the photographic material. The optimum concentration of development restrainer can be determined based on the described factors such as the particular photographic material, desired image, processing conditions, and the like.

A photographic element as described can be prepared by coating the described photographic composition on a suitable support. Any of the coating methods and means known in the photographic art can be useful for coating the described photographic composition on a suitable support. If desired, the described photographic element according to the invention can contain two or more layers. These layers, if desired, can be coated simultaneously using procedures known in the photographic art.

The photosensitive silver salt, especially the photosensitive silver halide, can be washed or unwashed to remove soluble salts after precipitation of the silver salt. The silver halide can be chemically sensitized, can contain development modifiers that function as speed-increasing compounds, and can contain antifoggants and emulsion stabilizers as described in the *Product Licensing Index,* Volume 92, December 1971, Publication 9232 published by Industrial Opportunities Ltd., Homewell, Havant, Hampshire, PO9 1EF, UK.

The photographic materials, as described, can also contain hardeners, antistatic layers, plasticizers, lubricants, coating aids, matting agents, brighteners and absorbing and filter dyes which do not adversely affect the desired properties of the heat developable and heat stabilizable photographic materials of the invention. These addenda are described in, for example, the above *Product Licensing Index* publication and in *Research Disclosure,* Volume 170, June 1978, Item 17029.

The coating composition containing the components necessary to produce a photographic element according to the invention can operate over a range of pH values. A typical pH of a coating composition to produce a photographic element according to the invention is within the range of about 4.0 to about 5.5.

The heat developable and heat stabilizable photographic materials, as described, can contain a variety of vehicles and binders, alone or in combination. The photographic material typically contains a polymeric binder. The described activator-stabilizer precursors are typically preformed merely by mixing the described components in the presence of a solvent. A suitable vehicle, however, can be useful in the preparation. Suitable vehicles and binders include both naturally-occurring substances such as proteins, for example, gelatin, gelatin derivatives, cellulose derivatives, polysaccharides such as dextran and the like; and synthetic polymeric materials such as water soluble polyvinyl compounds like poly(vinyl pyrrolidone), acrylamide polymers and the like. The photographic layer and other layers of a photographic element according to the invention, such as an overcoat layer, interlayer, subbing layer and the like can also contain alone or in combination with the described vehicles, other synthetic polymeric vehicle materials, such as dispersed vinyl compounds, for example, in latex form and particularly those which increase the dimensional stability of the photographic materials. Useful synthetic polymers include those described in the above *Product Licensing Index* and *Research Disclosure* publications. Effective polymeric binders can include water insoluble polymers of alkylacrylates and methacrylates, acrylic acid, sulfoalkylacrylates or methacrylates and those which have cross-linking sites which facilitate hardening or curing as well as those have recurring sulfobetaine units. Especially effective polymeric binders are those which can withstand processing temperatures above about 250° C.

The photographic and other layers of a photographic element as described can be coated on a variety of supports. It is essential that the support be able to withstand the described processing temperatures in order to avoid adverse sensitometric and other effects during processing. Typical supports include cellulose ester, poly(vinyl acetal), poly(ethyleneterephthalate), polycarbonate and related films and resinous materials as well as glass, paper, metal and the like. Typically, a flexible support is most useful, especially a paper support or transparent film support.

The photographic materials of the invention can contain spectral sensitizing dyes to confer additional sensitivity to the light sensitive silver salts, especially photosensitive silver halide, as described. Useful spectral sensitizing dyes are described in, for example, the *Product Licensing Index* and *Research Disclosure* publications mentioned. Combinations of spectral sensitizing dyes can be useful if desired. In addition, supersensitizing addenda which do not adsorb visible light can be useful in the described photographic materials.

The spectral sensitizing dyes and other addenda useful in the photographic materials according to the invention can be incorporated into these materials from aqueous compositions, such as water solutions, or suitable organic solvent compositions, such as organic solvent solutions. The sensitizing dyes and other addenda can be added using a variety of procedures known in the photographic art.

The described activator-stabilizer precursors are useful in a variety of physical locations in a photographic element according to the invention. The activator-stabilizer precursors are useful in one or more layers of the described photographic element, such as in the photosensitive silver salt containing layer and/or an overcoat layer and/or a layer between the photosensitive silver salt containing layer and the support. It is necessary that the described activator-stabilizer precursors be in a location with respect to the silver halide developing agent and the photosensitive silver salt which enables the desired interaction of the described components at processing temperature. The components are typically located contiguous to each other to enable the desired interaction. The term "in reactive association" as described herein is intended to mean that the described compounds are in such a location which enables the desired interaction to produce the desired developed and stabilized image at processing temperature.

The desired activator-stabilizer precursors are useful in a variety of heat developable and heat stabilizable photographic compositions. Accordingly, another embodiment of the invention is a heat developable and heat stabilizable photographic composition comprising, in binder, (a) photo-sensitive silver salt, such as photosensitive silver halide, (b) a photosensitive silver salt developing agent, and (c) a stabilizing concentration of an activator-stabilizer precursor having an acid portion and a base portion, as described wherein the activator-stabilizer precursor comprises an acylhydrazine which releases a base moiety upon heating to a temperature above about 130° C. and provides essential freedom from visible crystal formation in the processed photographic composition.

The described activator-stabilizer precursors are also useful in thermosensitive photographic silver salt processing compositions. Such thermosensitive photographic silver salt processing compositions include, for example, heat activatable silver halide developers, stabilizing compositions, fixing compositions, hardeners and the like which enable use of the base release and/or stabilizer release properties of the described activator-stabilizer precursors.

This is exemplified in an embodiment of the invention wherein a thermosensitive photographic processing composition comprises (a) a silver halide developing agent and (b) an activator-stabilizer precursor having an acid portion and a base portion wherein the activator-stabilizer precursor comprises an acylhydrazine, as described, which releases a base moiety upon being heated to a temperature above about 150° C., such as a temperature within the range of about 150° C. to about 190° C. An example of such a thermosensitive photographic processing composition comprising (a) a silver halide developing agent consisting essentially of a 3-pyrazolidone silver developing agent and (b) an activator-stabilizer precursor having an acid portion and a base portion wherein the activator-stabilizer precursor consists essentially of 1,1'-carbonylbis[2-(o-carboxybenzoyl)hydrazine]. Another example of a thermosensitive photographic processing composition, as described, comprises, in a gelatino binder, (a) a silver halide developing agent consisting essentially of 4-hydroxymethyl-4-methyl-1-phenyl-3-pyrazolidone and (b) an activator-stabilizer precursor consisting essentially of 1,1'-carbonylbis[2-o-carboxybenzoyl)-hydrazine]. Such a gelatino composition can be useful, for example, as an overcoat for a photographic element. A further example of a thermosensitive photographic processing composition comprises, in a gelatino binder, (a) a silver halide developing agent consisting essentially of 4-hydroxymethyl-4-methyl-1-phenyl-3-pyrazolidone and a combination of activator-stabilizer precursors consisting essentially of (b) 1,3-bis(2-amino-2-thiazolinyl)propane, (c) 1,3-bis-2S-(N,N'-ethyleneisothiourea)ethylurea, and (d) 1,1'-carbonylbis[2-(o-carboxybenzoyl)hydrazine].

The processing composition which is thermosensitive can contain a binder as described such as gelatin or ethyl cellulose.

Because the described activator-stabilizer precursors are useful as base-release agents to activate the described silver salt developing agents and as stabilizer precursors, no other base-release agent or stabilizer or stabilizer precursors are needed in the described materials of the invention. However, other base-release agents and other stabilizers or stabilizer precursors can be useful with the photographic materials and process of the invention if desired. For example, certain stabilizer precursors which form a stable silver complex upon heating the described elements can be useful in combination with the acylhydrazine activator-stabilizer precursors if desired. Examples of useful stabilizers or stabilizer precursors which can be used in combination with the described acylhydrazine activator-stabilizer precursors include certain isothiouronium compounds. Halogen containing stabilizer precursors, such as tetrabromobutane or 2-tribromomethylsulfonylbenzothiazole, can also be useful in combination with the acylhydrazine activator-stabilizer precursors.

After imagewise exposure of a photographic material according to the invention, the resulting image can be developed and stabilized by merely heating the photographic element to a temperature within the range of about 130° C. to about 200° C., such as 150° C. to 190°

C., typically a temperature within the range of about 170° C. to about 185° C., until the desired image is developed and stabilized. An image is typically developed and stabilized by heating the described photographic material to the desired processing temperature for about 1 to about 60 seconds, such as about 1 to about 30 seconds. By increasing or decreasing the time of heating, a higher or lower temperature within the described range can be useful.

A variety of imagewise exposure means and energy sources can be useful for producing a latent image in the described photographic material. The exposure means can be, for example, a light source, a laser, electronic beam, X-ray or similar exposure means. The exposure should be at least sufficient to produce a developable latent image in the photographic material.

Processing is typically carried out under ambient conditions of pressure and humidity. Pressures and humidity outside normal atmospheric conditions can be useful if desired; however, normal atmospheric conditions are preferred.

A variety of heating means can be useful for producing the necessary heating of the exposed photographic element as described. The photographic element according to the invention can be brought into contact with a simple hot plate, heated iron, heated rollers, dielectric heating means, air heating means or the like.

A small concentration of moisture can be present and in some instances very useful during processing. For instance, the concentrations of moisture present in a conventional photographic paper support at atmospheric conditions, such as at about 25° C. and 40 percent relative humidity, can be useful to aid in processing.

The described activator-stabilizer precursors can be useful in light-sensitive diazo type materials. The two components of the light-sensitive diazo type materials can contain at least one light-sensitive diazonium salt and at least one coupling compound which can react with the diazonium salt, typically in an alkaline medium to form an azo dye. In addition, a variety of other addenda, such as ultraviolet absorbers, acid stabilizers and the like can be present the described activator-stabilizer precursors in the diazo type material. The diazo type element containing the acylhydrazine activator-stabilizer precursor can be imagewise exposed to activating radiation through an original. The light exposure decomposes the diazonium salt. Thereafter, development of the exposed diazo type material can be accomplished by treatment with an alkaline medium. In lieu of externally supplied alkali, such as provided by ammonia to aid in development, the described activator-stabilizer precursor can be useful to aid in alkali release to produce development. The acylhydrazine activator-stabilizers, as described, when heated, such as to a temperature within the range of about 130° C. to about 200° C., such as 150° C. to 190° C., typically within the range of about 170° C. to about 185° C., generates base useful for initiating a coupling reaction in the diazo type material.

The following examples are included for a further understanding of the invention.

EXAMPLE 1

This illustrates the invention.

The following compositions were mixed and then coated at the designated coverages from aqueous solution on 4 mil thick poly(ethyleneterephthalate) film support containing a gelatin subbing layer:

| | mg/dm$^2$ |
|---|---|
| gelatin (binder) | 27.0 |
| surfactant (Surfactant 10G, a nonylphenoxypolyglycidol available from Olin Corp., U.S.A.) | 1.1 |
| 4-hydroxymethyl-4-methyl-1-phenyl-3-pyrazolidone (developing agent) | 14.0 |
| 1,3-bis(2-amino-2-thiazolinyl) propane (supplemental stabilizer) | 12.5 |
| 1,3-bis-2S-(N,N'-ethyleneisothiourea)ethyl urea (supplemental stabilizer) | 8.1 |
| 1,5-(bis-o-carboxybenzoyl) carbohydrazide (activator-stabilizer precursor) | 36.7 |
| silver bromoiodide (unsensitized, gelatino emulsion; 0.14μ silver bromoiodide grains) | 14.0 |

The coating composition was adjusted to 4.5 with 1.0 N sodium hydroxide. The resulting photographic element was allowed to dry at 40° C.

Samples of the resulting photographic element were imagewise exposed for $10^{-3}$ seconds sensitometrically to white light with a 0.8 neutral density filter in a commercial sensitometric exposure apparatus to produce a developable latent image in the photographic element. The exposed element was then processed by heating the element on a heated metal block at a temperature of 180° C. for 20 seconds. A developed and stabilized image was produced. The developed image had a purple tone and was stable to light. The image had a maximum density of 1.9 and a minimum density of 0.2.

The procedure was repeated with the exception that the photographic element was incubated at 38° C. and 50% relative humidity before processing. After incubation and processing the developed image in the element had a maximum density of 1.6 and a minimum density of 0.1. The developed and stabilized image was free from "pinholes" and free from post-processing crystal formation. The processed element was also free from undesired volatile byproducts during processing.

EXAMPLE 2

Two tests were found useful to determine whether a given activator-stabilizer precursor was able to release a stabilizer moiety at a temperature below 200° C. within a period of less than 60 seconds. These two tests were carried out as follows:

(1) Test A designated as silver halide dissolution test

In this test silver halide grains which were photosensitive silver bromoiodide were coated onto a poly(ethyleneterephthalate) film support from aqueous solution at pH 4.5 with the following composition:

| | mg/dm$^2$ |
|---|---|
| photosensitive silver bromoiodide emulsion (unsensitized gelatino emulsion; 0.14μ silver bromoiodide grains) | 14.0 |
| photographic gelatin (binder) | 27.0 |
| surfactant (Surfactant 10G) | 1.1 |
| 1,3-bis-2S-(N,N'-ethyleneisothiourea)ethyl urea (supplemental stabilizer precursor) | 8.1 |

-continued

| | mg/dm² |
|---|---|
| precursor to be tested | 1.4 milli-equivalent per 929 cm² |

The thermally induced silver halide dissolution rate (which is related to the rate of silver halide stabilization) measurements were carried out with a spectrophotometer equipped with a high-temperature cell. The cell allows the film to be heated to the desired temperature immediately after insertion of the film into the spectrophotometer. Optical density measurements at 500 nm were selected to follow the amount of undissolved silver halide.

(2) Test B designated as the solution stability test

Solution stability was determined for each precursor by a process as follows:

The results from these two tests are given in terms of two parameters: (1) $R_s$ which is the relative solution stability of an activator-stabilizer precursor in relation to 1,5-(bis-o-carboxybenzoyl)-carbohydrazide (activator-stabilizer precursor from Example 1), and (2) $R_d$ which is the silver halide dissolution rate relative to the same reference, i.e. in relation to silver halide stabilization rate. In a heat developable photographic material, such as described in Example 1 in which the activator-stabilizer precursor is replaced with another proposed activator-stabilizer precursor, a compound was considered to be acceptable as a possible activator-stabilizer precursor if the parameter $R_s$ was equal to or less than 1.0 and the parameter $R_d$ was larger than 0.1 as a result of the described tests. The results of tests with particular compounds are given in following Table I:

TABLE I

| | Compound Tested | $R_s$ | $R_d$ |
|---|---|---|---|
| (A) | N,N'-ethylenebis(phthalamic acid) (comparative example) (This compound resulted in undesired crystal formation in a heat processed photographic element) | 1.00 | 1.00 |
| (B) | 1,5-(bis-o-carboxybenzoyl)carbohydrazide | 0.35 | 0.70 |
| (C) | 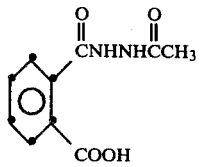 | 0.19 | 1.03 |
| (D) | 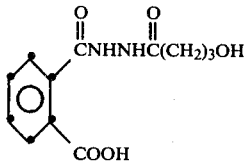 | 0.05 | 1.33 |
| (E) | 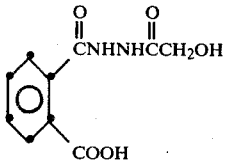 | 0.01 | 1.21 |

TABLE I-continued

| | Compound Tested | $R_s$ | $R_d$ |
|---|---|---|---|
| (F) | 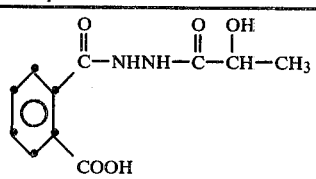 | 0.01 | 1.10 |
| (G) | 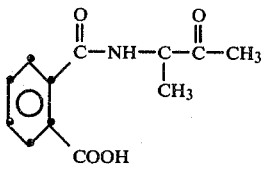 (comparative example) | 0.07 | 0.70 |
| (H) | 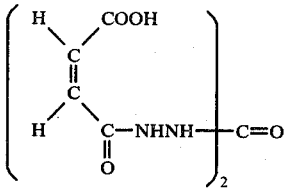 (comparative example) | 0.01 (not considered useful) | 0.05 |
| (I) | 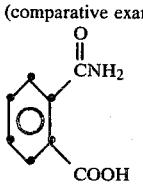 (comparative example) | 1.19 (not considered useful) | 0.44 |
| (J) | 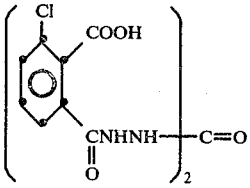 | 0.29 | 0.61 |

EXAMPLE 3

This is a comparative example.

Heat developable photographic compositions were prepared by mixing the components designated for compositions A and B and coating the resulting compositions at the designated coverages as follows:

| Component | Coverage (mg/dm²) (comparative example) Composition A | (invention) Composition B |
|---|---|---|
| photosensitive silver bromoiodide gelatino emulsion (sulfur and gold sensitized, 0.14μ average grain size) | 15.1 | 15.1 |
| gelatin (binder) | 33.0 | 33.0 |
| surfactant (Surfactant 10G) | 1.7 | 1.7 |
| 1,3-bis-25-(N,N'-ethylene isothiourea)ethylurea (stabilizer precursor) | 8.9 | 8.9 |
| 1,3-bis(2-amino-2-thiazolinyl)propane (stabilizer precursor) | 13.8 | 13.8 |
| N-butyric acid phthalamic acid (also named as N-3-carboxypropyl phthalamic acid) (comparative compound) | 35.6 | none |

-continued

| Component | Coverage (mg/dm²) (comparative example) Composition A | (invention) Composition B |
|---|---|---|
| 1,5-(bis-o-carboxynbenzoyl)carbohydrazide (activator-stabilizer precursor) | none | 42.2 |
| 4-hydroxymethyl-4-methyl-1-phenyl-3-pyrazolidone (developing agent) | 15.4 | 15.4 |

The composition A before coating was adjusted to pH 4.8 with 6 N $HNO_3$. The composition B before coating was adjusted to pH 4.5. Each of the compositions was coated on a poly(ethyleneterephthalate) film support at the designated coverages. Each of the coatings was permitted to dry and then was overcoated with poly(methylmethacrylate) at a coverage of 8 mg/dm².

Each resulting heat developable photographic element was sensitometric exposed to light in a commercial sensitometer for $10^{-3}$ seconds through a 1.36 neutral filter to produce a developable latent image in each element. The imagewise exposed elements were then processed by heating the elements at 180° C. for 20 seconds. The procedure was also repeated with the exception that the elements prior to processing were incubated for two weeks at 38° C. and 50% relative humidity along with unprocessed elements stored in a freezer at 0° C. for two weeks. After incubation, each of the elements was imagewise exposed and then heated in the same manner as the elements that were not incubated.

The results indicated that composition B (invention) produced less photographic speed loss (minus 0.2 log E) than composition A (comparative example) (minus 0.57 log E) after incubation. The composition B produced a physical cracking problem in the processed coating which occurred in both fresh and incubated samples. This problem did not change the fact that the image in the element was developed and stabilized.

EXAMPLE 4

This is a comparative example.

The following heat developable photographic compositions were prepared by mixing the components designated for compositions C and D and coating the resulting compositions at the designated coverages as follows:

| Component | Coverage (mg/929 cm²) (comparative example) Composition C | (comparative example) Composition D |
|---|---|---|
| photosensitive silver bromoiodide gelatino emulsion (sulfur and gold sensitized, 0.14μ average grain size) | 130 | 130 |
| gelatin (binder) | 250 | 250 |
| surfactant (Surfactant 10G) | 10 | 10 |
| 4-hydroxymethyl-4-methyl-1-phenyl-3-pyrazolidone (developing agent) | 130 | 130 |
| N-3-carboxypropyl phthalamic acid (also named N-butyric acid phthalamic acid) | 300 | none |
| 1,3-bis(2-amino-2-thiazolinyl)propane | 116 | 116 |

-continued

| Component | Coverage (mg/929 cm²) (comparative example) Composition C | (comparative example) Composition D |
|---|---|---|
| 1,3-bis-2S-(N,N'-ethylene isothiourea)ethyl urea | 75 | 75 |
| N,N'-ethylenebis(phthalamic acid) | none | 315 |

Each composition was coated onto a poly(ethyleneterephthalate) film support. Samples of each resulting heat developable photographic element were imagewise exposed sensitometrically to light in a commercial sensitometer through a 1.2 neutral density filter to produce a developable latent image in each element. The imagewise exposed elements were then processed by heating at 180° C. for 15 seconds to produce a developed image in each element. The element containing composition C produced an image having a maximum specular density of 1.9 and a minimum density of 0.24. The procedure was repeated except that the elements containing compositions C and D were incubated for two weeks before exposure and processing. The maximum and minimum density values for the developed images in each of the fresh and incubated elements indicated undesired post-processing crystal formation occurred in the element of composition D. The element of composition C was free of such crystal formation. However, an element of the invention (Example 1) produced less speed loss than an element containing composition C.

Other acylhydrazine compounds that can be useful activator-stabilizer precursors include the following:

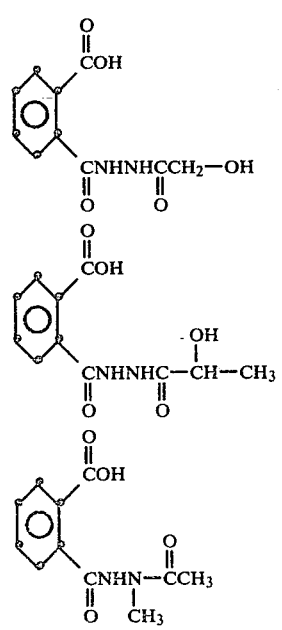

-continued

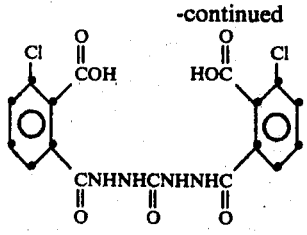

The invention has been described in detail with particular reference to preferred embodiments thereof, but it will be understood that variations and modifications can be effected within the spirit and scope of the invention.

What is claimed is:

1. In a heat developable and heat stabilizable photographic element comprising a support having thereon, in binder, and in reactive association, (a) a photosensitive silver salt, (b) a photosensitive silver salt developing agent, and (c) a stabilizing concentration of an activator-stabilizer precursor having an acid portion and a base portion, the improvement wherein said activator-stabilizer precursor consists essentially of an acylhydrazine represented by the structure:

$$R^3-\overset{O}{\overset{\|}{C}}-NH-NR^1R^2 \text{ or} \qquad (I)$$

$$[R^3-\overset{O}{\overset{\|}{C}}-NH-NH]_2-C=O \qquad (II)$$

$R^1$ is hydrogen or alkyl containing 1 to 3 carbon atoms;

$R^2$ is $-CO-R^4$ or $-SO_2-R^4$;

$R^3$ is 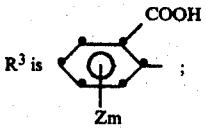 ;

Z is hydrogen or an electron withdrawing group;

m is 1 to 4; when Z is hydrogen, m is 4;

$R^4$ is alkyl containing 1 to 3 carbon atoms or hydroxyalkyl containing 1 to 4 carbon atoms which releases a base moiety upon being heated to a temperature above about 130° C. and provides essential freedom from visible crystal formation in the processed photographic element.

2. In a heat developable and heat stabilizable composition comprising, in binder, (a) photosensitive silver salt, (b) a photosensitive silver salt developing agent, and (c) a stabilizing concentration of an activator-stabilizer precursor having an acid portion and a base portion, the improvement wherein said activator-stabilizer precursor consists essentially of an acylhydrazine represented by the structure:

$$R^3-\overset{O}{\overset{\|}{C}}-NH-NR^1R^2 \text{ or} \qquad (I)$$

$$[R^3-\overset{O}{\overset{\|}{C}}-NH-NH]_2-C=O \qquad (II)$$

wherein $R^1$ is hydrogen or alkyl containing 1 to 3 carbon atoms;

$R^2$ is $-CO-R^4$ or $-SO_2-R^4$;

$R^3$ is 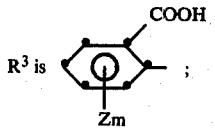 ;

Z is hydrogen or an electron withdrawing group;

m is 1 to 4; when Z is hydrogen, m is 4;

$R^4$ is allyl containing 1 to 3 carbon atoms or hydroxyalkyl containing 1 to 4 carbon atoms which releases a base moiety upon being heated to a temperature above about 130° C. and provides essential freedom from visible crystal formation in the processed photographic composition.

3. In a thermosensitive photographic processing composition comprising (a) a silver halide developing agent and (b) an activator-stabilizer precursor having an acid portion and a base portion, the improvement wherein said activator-stabilizer precursor consists essentially of an acylhydrazine represented by the structure:

$$R^3-\overset{O}{\overset{\|}{C}}-NH-NR^1R^2 \text{ or} \qquad (I)$$

$$[R^3-\overset{O}{\overset{\|}{C}}-NH-NH]_2-C=O \qquad (II)$$

wherein $R^1$ is hydrogen or alkyl containing 1 to 3 carbon atoms;

$R^2$ is $-CO-R^4$ or $-SO_2-R^4$;

$R^3$ is 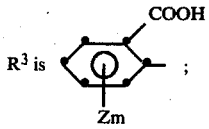 ;

Z is hydrogen or an electron withdrawing group;

m is 1 to 4; when Z is hydrogen, m is 4;

$R^4$ is alkyl containing 1 to 3 carbon atoms or hydroxyalkyl containing 1 to 4 carbon atoms which releases a base moiety upon being heated to a temperature above about 130° C.

4. A process of developing and stabilizing an image in an exposed photographic element comprising a support having thereon, in binder, and in reactive association, (a) a photosensitive silver salt, (b) a photosensitive silver salt developing agent, and (c) a stabilizing concentration of an activator-stabilizer precursor consisting essentially of an acylhydrazine represented by the structure:

$$R^3-\overset{O}{\overset{\|}{C}}-NH-NR^1R^2 \text{ or} \qquad (I)$$

$$[R^3-\overset{O}{\overset{\|}{C}}-NH-NH]_2-C=O \qquad (II)$$

wherein $R^1$ is hydrogen or alkyl containing 1 to 3 carbon atoms;

$R^2$ is —CO—$R^4$ or —$SO_2$—$R^4$;

$R^3$ is 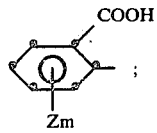

;

Z is hydrogen or an electron withdrawing group;

m is 1 to 4; when Z is hydrogen, m is 4;

$R^4$ is alkyl containing 1 to 3 carbon atoms or hydroxyalkyl containing 1 to 4 carbon atoms which releases a base moiety upon being heated to a temperature above about 130° C.; comprising heating said element to a temperature within the range of 130° C. to 200° C. until said image is developed and stabilized.

5. A heat developable and heat stabilizable photographic element as in claim 1 wherein said acylhydrazine consists essentially of 1,1'-carbonylbis[2-(o-carboxybenzoyl)hydrazine].

6. A heat developable and heat stabilizable photographic element as in claim 1 wherein said acylhydrazine consists essentially of 1-o-carboxybenzoyl-2-(4-hydroxybutyryl)hydrazine.

7. A heat developable and heat stabilizable photographic element as in claim 1 wherein said acylhydrazine consists essentially of 1-(o-carboxybenzoyl)-2-acetyl-2-methylhydrazine.

8. A heat developable and heat stabilizable photographic element as in claim 1 wherein the photosensitive silver salt consists essentially of photographic silver halide.

9. A heat developable and heat stabilizable photographic element as in claim 1 wherein said stabilizing concentration is within the range of 0.2 to 4 moles of said activator-stabilizer precursor per mole of said photosensitive silver salt.

10. In a heat developable and heat stabilizable photographic element comprising a support having thereon, in a gelatino binder, and in reactive association, (a) photographic silver halide, (b) a 3-pyrazolidone silver halide developing agent, and a stabilizing concentration of (c) an activator-stabilizer precursor having an acid portion and a base portion, the improvement wherein said activator-stabilizer precursor consists essentially of 1,1'-carbonylbis[2-(o-carboxybenzoyl)hydrazine].

11. A heat developable and heat stabilizable photographic element comprising a support having thereon, in a gelatino binder, and in reactive association, (a) photographic silver halide, (b) a silver halide developing agent consisting essentially of 4-hydroxymethyl-4-methyl-1-phenyl-3-pyrazolidone, and a stabilizing concentration of a combination of activator-stabilizer precursors consisting essentially of (c) 1,3-bis(2-amino-2-thiazolinyl)propane, (d) 1,3-bis-2S-(N,N'-ethyleneisothiourea) ethyl area, and (e) 1,1-carbonylbis[2-(o-carboxybenozyl)hydrazine].

12. A heat developable and heat stabilizable photographic composition as in claim 2 wherein said acylhydrazine consists essentially of 1,1-carbonylbis[2-(o-carboxybenzoyl)hydrazine].

13. A heat developable and heat stabilizable photographic composition as in claim 2 wherein said acylhydrazine consists essentially of 1-o-carboxybenzoyl-2(4-hydroxybutyryl)hydrazine.

14. A heat developable and heat stabilizable photographic composition as in claim 2 wherein said acylhydrazine consists essentially of 1-(o-carboxybenzoyl)-2-acetyl-2-methylhydrazine.

15. A heat developable and heat stabilizable photographic composition as in claim 2 wherein said photographic silver salt consists essentially of photographic silver halide.

16. A heat developable and heat stabilizable photograhic composition as in claim 2 wherein said stabilizing concentration is within the range of 0.2 to 4 moles of said activator-stabilizer precursor per mole of said photographic silver salt.

17. In a heat developable and heat stabilizable photographic composition comprising, in a gelatino binder, (a) photographic silver halide, (b) a 3-pyrazolidone silver halide developing agent, and a stabilizing concentration of (c) an activator-stabilizeer precursor having an acid portion and a base portion, the improvement wherein said activator-stabilizer precursor consists essentially of 1,1'-carbonylbis[2-(o-carboxybenzoyl)hydrazine].

18. A heat developable and heat stabilizable photographic composition comprising, in a gelatino binder, (a) photographic silver halide, (b) a silver halide developing agent consisting essentially of 4-hydroxymethyl-4-methyl-1-phenyl-3-pyrazolidone and a stabilizing concentration of a combination of activator-stabilizer precursors consisting essentially of (c) 1,3-bis(2-amino-2-thiazolinyl)propane, (d) 1,3-bis-2S-(N,N'-ethyleneisothiourea) ethyl urea, and (e) 1,1'-carbonylbis[2-(o-carboxybenzoyl)hydrazine].

19. In a thermosensitive photographic processing composition comprising (a) a silver halide developing agent consisting essentially of a 3-pyrazolidone silver halide developing agent and (b) an activator-stabilizer precursor having an acid portion and a base portion, the improvement wherein said activator-stabilizer precursor consists essentially of 1,1'-carbonylbis[2-(o-carboxybenzoyl)hydrazine].

20. A thermosensitive photographic processing composition comprising, in a gelatino binder, (a) a silver halide developing agent consisting essentially of 4-hydroxymethyl-4-methyl-1-phenyl-3-pyrazolidone and (b) an activator-stabilizer precursor consisting essentially of 1,1'-carbonylbis[2-(o-carboxybenzoyl)hydrazine].

21. A thermosensitive photographic processing composition comprising, in a gelatino binder, (a) a silver halide developing agent consisting essentially of 4-hydroxymethyl-4-methyl-1-phenyl-3-pyrazolidone and a combination of activator-stabilizer precursors consisting essentially of (b) 1,3-bis(2-amino-2-thiazolinyl)propane, (c) 1,3-bis-2S-(N,N'-ethyleneisothiourea) ethyl urea, and (d) 1,1'-carbonylbis[2-(o-carboxybenzoyl)hydrazine].

22. A process of developing and stabilizing an image in an exposed photographic element as defined in claim 10 comprisiing heating said element to a temperature within the range of 130° C. to 200° C. until said image is developed and stabilized.

23. A process of developing and stabilizing an image in an exposed photographic element as defined in claim 11 comprising heating said element to a temperature within the range of 130° C. to 200° C. until said image is developed and stabilized.

* * * * *

UNITED STATES PATENT AND TRADEMARK OFFICE

CERTIFICATE OF CORRECTION

PATENT NO. : 4,207,392

DATED : June 10, 1980

INVENTOR(S) : Daniel D. Shiao and Lawrence R. Morrow

It is certified that error appears in the above-identified patent and that said Letters Patent are hereby corrected as shown below:

Column 2, lines 44-45, "hydrazinehydrazide" should read --- hydrazine-hydrazide ---.

Column 9, line 52, "desired" should read ---described---; line 57, "photo-sensitive" should read ---photosensitive---.

Column 10, line 20, after "silver" insert ---halide---.

Column 11, line 30, "concentrations" should read ---concentration---.

Column 15, line 9, that part of the formula reading "carboxynbenzoyl" should read ---carboxybenzoyl---.

Column 17, line 34, before "$R^1$ is" insert ---wherein---.

Column 18, line 13, "allyl" should read ---alkyl---.

UNITED STATES PATENT AND TRADEMARK OFFICE

CERTIFICATE OF CORRECTION

PATENT NO. : 4,207,392

DATED : June 10, 1980

INVENTOR(S) : Daniel D. Shiao and Lawrence R. Morrow

It is certified that error appears in the above-identified patent and that said Letters Patent are hereby corrected as shown below:

Column 20, lines 11-12, "photograhic" should read ---photographic---; line 20, "activator-stabilizeer" should read --- activator-stabilizer ---; line 60, "comprisiing" should read ---comprising---.

Signed and Sealed this

*Sixteenth* Day of *December 1980*

[SEAL]

*Attest:*

*Attesting Officer*

SIDNEY A. DIAMOND

*Commissioner of Patents and Trademarks*